United States Patent [19]

Sycle, Jr.

[11] 4,032,036

[45] June 28, 1977

[54] RETAINING CLIP

[75] Inventor: Junius Sycle, Jr., New Shrewsbury, N.J.

[73] Assignee: The United States of America as represented by the Secretary of the Navy, Washington, D.C.

[22] Filed: Nov. 1, 1976

[21] Appl. No.: 737,635

[52] U.S. Cl. ..... 220/324; 220/301; 292/258

[51] Int. Cl.[2] ..... B65D 45/16

[58] Field of Search ..... 220/293, 296–298, 220/301, 324; 292/258

[56] References Cited

UNITED STATES PATENTS

| | | | |
|---|---|---|---|
| 1,687,887 | 10/1928 | Pletcher | 220/301 |
| 2,760,674 | 8/1956 | Karp | 220/324 |

*Primary Examiner*—George T. Hall
*Attorney, Agent, or Firm*—R. S. Sciascia; Henry Hansen; William J. Iseman

[57] ABSTRACT

A U-shaped retaining clip for holding covers on ammunition cartridge tanks. One leg of the clip has a smooth inner surface which engages the outside of the tank rim and is easily lifted to remove the clip. The other leg includes at least one prong extending inwardly of the clip to embed the inside of the rim and a portion jutting adjacent the cover to retain said cover in a locked position within the tank.

12 Claims, 5 Drawing Figures

FIG. 2
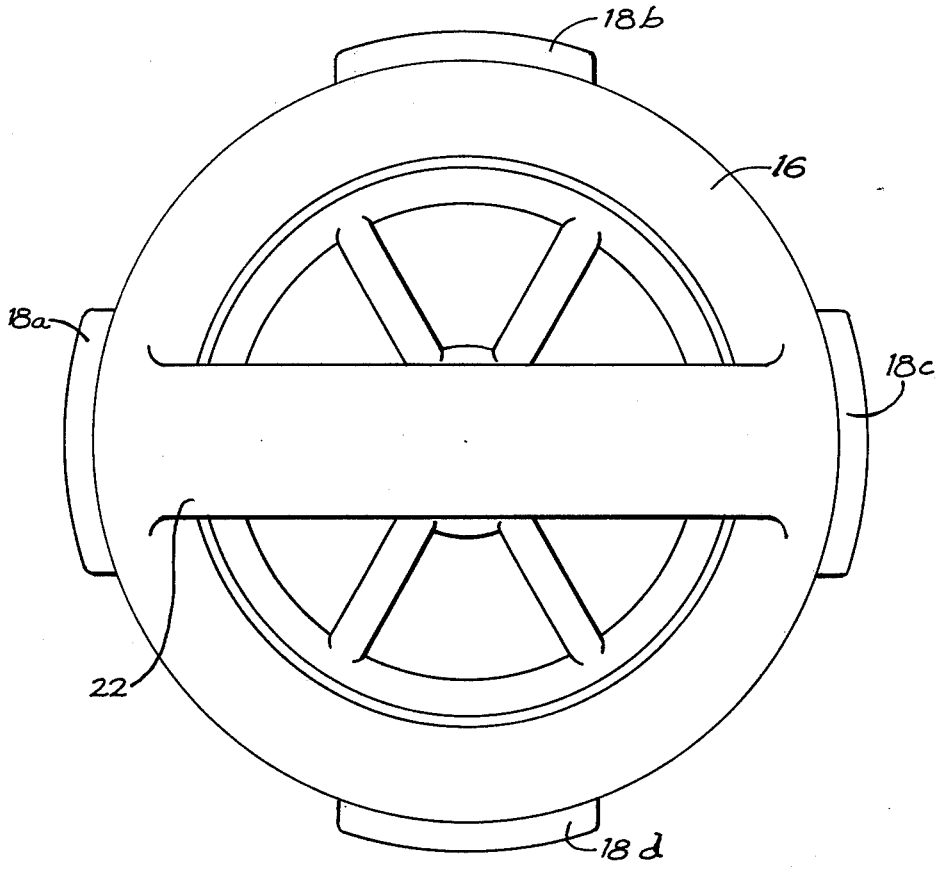
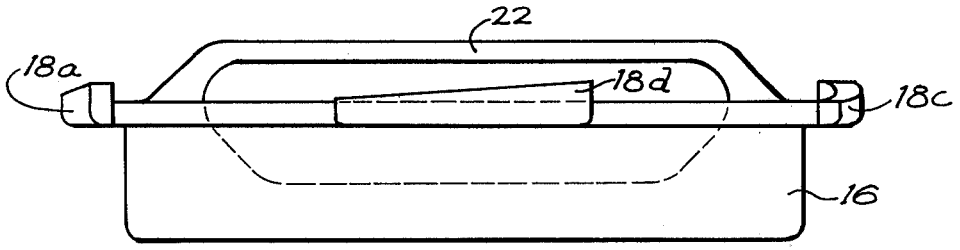
FIG. 3

RETAINING CLIP

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

This invention relates generally to fastening means adapted to be used with container covers and particularly to a U-shaped retaining clip for holding rotatably engageable covers on ammunition cartridge tanks.

Ammunition tanks have long been used in great quantities for the storage and shipping of munitions. Such tanks in the simplest form resemble an elongated hollow tube open at one end and having a rim formed thereon for rotatably engaging an end cover or cap. One method presently used to retain the engagement of the cap with the tank involves the rotation of the cap within the rim portion of the tank until tight and the securing of the cap in the tightened position by means of a length of wire threaded through openings formed in the rim and engaging a portion of the cover while in the tightened position. The ends of the wire are twisted and trimmed to retain the cover in a locked position. Considering the large quantities of cartridge tanks presently in use, the foregoing method consumes relatively large amounts of time as well as requiring a significant amount of dexterity. Moreover, the wires are capable of rusting and parting and the twisted ends thereof are subject to physical abuse sufficient to cause disengagement of the cover from the cartridge tank.

SUMMARY OF THE INVENTION

Accordingly, it is an object of the present invention to provide a U-shaped retaining clip for holding covers on ammunition cartridge tanks. Anothher object of the invention is to provide a retaining clip which can be conveniently installed in a minimum period of time and with a minimum requirement of dexterity. A further object of the present invention is to provide a retaining clip for ammunition cartridge tanks which is positive acting and vigorously resists disengagement of the cover from the tank. Yet another object is to provide a retaining clip which is relatively small in size, resists corrosion, and presents a minimum of protruding edges.

Briefly, these and other objects are accomplished by a U-shaped retaining clip made of a corrosion resistant single strap of spring metal for holding covers on ammunition cartridge tanks. One leg of the clip has a smooth inner surface which engages the outside of the cartridge tank rim and is easily lifted to remove the clip. The other leg includes at least one prong extending inwardly of the clip to embed the inside of the tank rim and having a portion jutting adjacent the cover for retaining the cover in a locked position within the tank.

For a better understanding of these and other aspects of the invention, reference may be made to the following detailed description taken in conjunction with the accompanying drawings.

BRIEF DESCRIPTION OF THE DRAWINGS

FIG. 2 is a top elevation view of the tank cover shown in FIG. 1;

FIG. 3 is a side elevation view of the tank cover shown in FIG. 2;

DESCRIPTION OF THE PREFERRED EMBODIMENT

Figure 1:
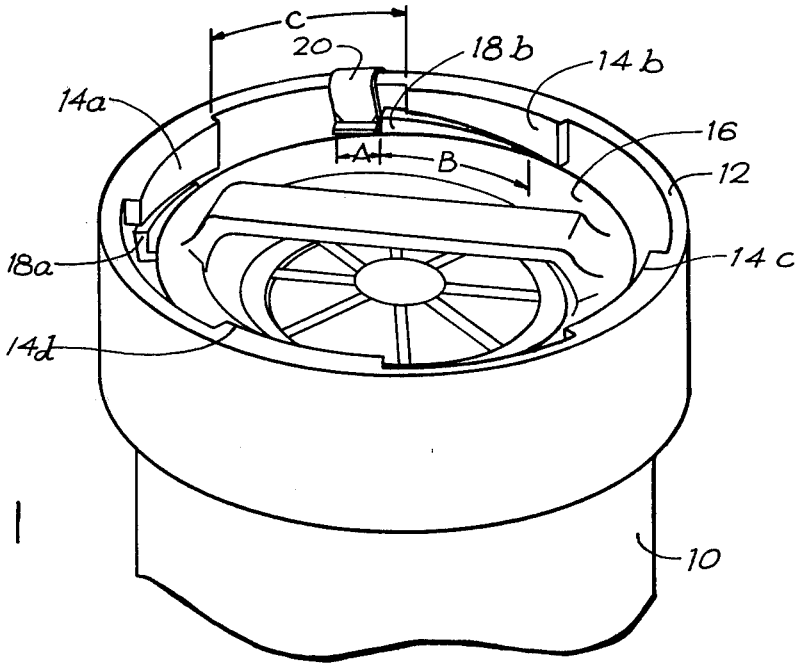
FIG. 1 is a perspective view of an end portion of a cartridge tank utilizing the retaining clip of the present invention.

Referring now to FIG. 1, there is shown a perspective view of a portion of a cartridge tank 10 having a rim 12 formed at the open end thereof. The rim 12 includes a plurality of cammed rim lugs 14*a, b, c, d* formed interior to the rim 12 and equally spaced about the interior periphery thereof with recesses formed therebetween. A tank cover 16 is shown inserted and in a tightened position with respect to the tank 10 and rim 12. The cover 16 includes a plurality of cammed cover lugs 18*a, b, c, d* equally spaced about the outer periphery of the cover and is shown in partial engagement with corresponding lugs on the rim. A U-shaped retaining clip 20 is shown seated on the rim 12 and abutting with a portion of one side thereof the end of the cam cover lug 18*b*. The width of the retaining clip 20 is denoted as distance A and the arcuate widths of each of the cammed cover lugs is denoted as B as shown with respect to lug 18*b*. The recesses formed about the inner periphery of the rim 12 between the respective cover lugs 18*a, b, c, d* all have an arcuate width denoted as C.

Referring now to FIG. 2 there is shown a top elevation view of the cover 16 shown in FIG. 1. More clearly shown is the arrangement of the cammed cover lugs 18*a, b, c, d* equally spaced about the outer periphery of the cover 16. The handle 22 is secured at the respective ends thereof to the cover 16 in order to facilitate insertion and removal of the cover within the tank.

FIG. 3 illustrates a side elevation view of the cover 16 shown in FIG. 2 and more clearly illustrates the curvatures and elevation formed within each of the cammed cover lugs 18*a, b, c, d.* Also more clearly shown is the placement of the handle 22 with respect to the cover 16 and the indentation formed therein to facilitate manual handling of the cover.

Figure 4:
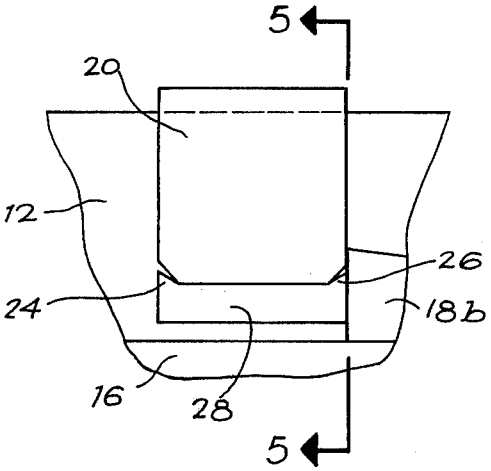
FIG. 4 is a magnified view of the clip of the present invention as shown in FIG. 1.

Referring now to FIG. 4 there is shown a magnified view of the clip 20 as employed in relation to selected fragmented portions of the rim 12 and the cover 16. The retaining clip 20 is shown fitted over the top of the rim 12 with the bottom portion of the clip abutting one end surface of the cammed cover lug 18*b*. The clip 20 is a forced friction fit over the rim 12 and is further locked in alignment therewith by a pair of prongs 24, 26 formed within one leg of the clip and extending inwardly towards the interior surface of the rim. The clip 20 also includes a flat portion 28 extending outwardly from the rim 12 and towards the center of the cover 16.

Figure 5:
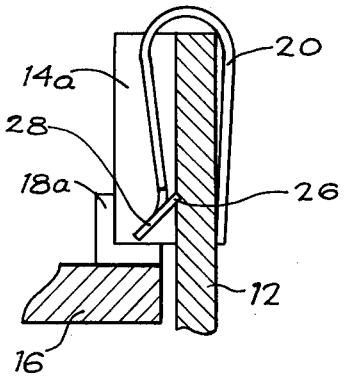
FIG. 5 is a side view of the invention taken along the lines 5—5 noted in FIG. 4.

Referring now to FIG. 5, there is shown a side elevation view of the clip 20 taken along the lines 5—5 shown in FIG. 4. More clearly shown is the embedment of one of the prongs 26 within a portion of the rim 12. The flat portion 28 of the inside leg is also shown as a pronounced departure from the clip 20 about a crease formed substantially intermediate the prongs 24, 26. The flap portion 28 provides a V-shape near the distal end of the leg by making an obtuse angle with the remainder of the leg which is substantially straight.

Shown behind the clip 20 is one end surface of the cammed rim lug 14*a* with the corresponding cammed cover lug 18*a* behind and underneath the lug 14*a*. As clearly illustrated in the respective positioning between the clip 20 and the lugs 14*a*, 18*a*, the side of the clip 20 adjacent the flat portion 28 and the prong 26 is designed to rest adjacent the end surface of the succeeding cammed cover lug 18*b* (not shown) and thus block the rotation of the cover 16 within the rim 12. Similarly, the opposite side of the flat portion 28 incorporating prong 24 will block movement of the clip past the end surface of the cammed rim lug 14*a*.

Referring again to FIGS. 1–5, the operation of the invention will now be explained. It may be seen in the illustration of FIG. 1, that the cover 16 is inserted into the recess of tank rim 12 with the cammed cover lugs 18*a*, *b*, *c*, *d* initially passing through the rim recesses formed between the rim lugs 14*a*, *b*, *c*, *d*. In this particular embodiment, the cover 16 is tightened within the tank and rim by a clockwise motion causing the cammed surfaces of the respective lugs to frictionally engage with each other in a wedge like manner due to the helical threading arrangement formed between the lugs on the cover and the lugs on the rim. In a typical sealing operation, the handle 22 is either gripped manually or by some instrument capable of torquing the cover with the rim to a predetermined value. At this point, the retaining clip 20 is placed on the rim 12 and pushed or hammered until both legs are well seated upon and over the rim as noted in the drawing. Force is required to seat the clip 20 due to the U-shaped form and spring characteristics of the clip which is intended to grip the opposing surfaces of rim 12 in a relatively tight manner. The clip 20 is formed as a single strap of metal such as corrosion resistant spring steel and the points of the prongs 24, 26 automatically dig into and become embedded in the interior surface of the rim 12 in self-locking angled relationship therewith. Under the compressive spring force of the clip 20, the cover is prevented from the turning in a counter clockwise direction. The respective pitches of the cammed lugs 14, 18 prevent the further turning of the cover 16 in a clockwise direction and allow removal of the cover 16 from the tank and rim only by means of rotation in a counter clockwise direction. The clip 20 is positioned over the rim 12 at such a point intermediate the rim lugs as shown in the drawing of FIG. 1 such that the counter clockwise rotation of the lug 18*b* is blocked by the position of the clip. Should even a severe blow be imparted to the cover 16 so as to cause the cover to rotate in a counter clockwise motion, the clip 20 may, in extreme circumstances, also be forced in a counter clockwise direction but will ultimately block against the end surface of the rim cover lug 14*a* such as shown in the drawing. To insure that the cover will never disengage completely from the rim 12 while the clip 20 is in position, the width A of the clip 20 is chosen such that when added to the arcuate width B of the cammed cover lug will always exceed the arcuate width C of the recess formed in the rim 12 between succeeding rim lugs. When it is desired to remove the cover 16 from the tank 10, one need only use an elongated tool such as a screwdriver shank placed under the flat portion 28 of the clip to disengage the prongs from embedding the rim and to pry the clip 20 therefrom.

Thus it may be seen that there has been provided a novel U-shaped retaining clip for holding caps or covers on ammunition cartridge tanks.

Obviously, many modifications and variations of the invention are possible in light of the above teachings. For example, the leg of the clip positioned interior to the rim of the tank may have a hump formed therein to create a larger surface area on the side thereof for increasing the blocking qualities of the clip. It is therefore to be understood that within the scope of the appended claims, the invention may be practiced otherwise than as specifically described.

What is claimed is:

1. Sealing means for a tubular casing having a plurality of cammed lugs equally spaced about the interior of a rim formed at the open end thereof, comprising, in combination:

a circular cover adapted to be inserted in the rim of the casing for locking therewith, said cover having equally spaced about the periphery thereof a plurality of cammed lugs for rotatably engaging the lugs of the casing when said cover is rotated in one direction; and a U-shaped retaining clip having a pair of legs for compressively engaging the opposing surfaces of the casing rim between succeeding ones of the rim lugs and having a jutting portion on one leg for blocking the rotation of a selected one of said cover lugs in a direction opposite to said one direction thereby to retain said cover in locking engagement with the casing.

2. Sealing means according to claim 1 wherein said retaining clip has a width which when added to the arcuate width of a selected one of said cover lugs is greater than the arcuate width of a selected one of the recesses formed between succeeding ones of the rim lugs.

3. Sealing means according to claim 2 wherein said jutting portion of said clip is a flat formed along a crease near the distal end of said one leg and at an abtuse angle therewith.

4. Sealing means according to claim 3 wherein said clip has at least one prong extending inwardly of said one leg for embedding the interior surface of the rim.

5. Sealing means according to claim 4 wherein said clip has a pair of prongs formed at opposing ends of said crease, each of said prongs extending inwardly of said one leg for simultaneously embedding the interior surface of the rim.

6. Sealing means according to claim 5 wherein said retaining clip is made of a single strap of spring metal.

7. A lockable casing for a munition cartridge, comprising, in combination:

an elongated hollow tube open at one end and adapted to enclose the cartridge;

a rim formed about said open end of said tube, said rim having a plurality of cammed lugs equally spaced about the interior thereof;

a circular cover adapted to be inserted in said rim for locking therewith, said cover having equally spaced about the periphery thereof a plurality of cammed lugs for rotatably enngaging the lugs of said casing when said cover is rotated in one direction; and a U-shaped retaining clip having a pair of legs for compressively engaging the opposing surfaces of said casing rim between succeeding ones of said rim lugs and having a jutting portion on one leg for blocking the rotation of a selected one of said cover lugs in a direction opposite to said one direction thereby to retain said cover in locking engagement with said tube and said rim.

8. A lockable casing according to claim 7 wherein said retaining clip has a width which when added to the arcuate width of a selected one of said cover lugs is greater than the arcuate width of a selected one of the recesses formed between succeeding ones of said rim lugs.

9. A lockable casing according to claim 8 wherein said jutting portion of said clip is a flat formed along a crease near the distal end of said one lug and at an obtuse angle therewith.

10. A lockable casing according to claim 9 wherein said clip has at least one prong extending inwardly of said one leg for embedding the interior surface of said rim.

11. A lockable casing according to claim 10 wherein said clip has a pair of prongs formed at opposing ends of said crease, each of said prongs extending inwardly of said one leg for simultaneously embedding the interior surface of said rim.

12. A lockable casing according to claim 11 wherein said retaining clip is made of a single strap of spring metal.

* * * * *